US009482058B2

(12) United States Patent
Siracki

(10) Patent No.: US 9,482,058 B2
(45) Date of Patent: Nov. 1, 2016

(54) CUTTING STRUCTURES AND STRUCTURES FOR RETAINING THE SAME

(71) Applicant: Smith International, Inc., Houston, TX (US)

(72) Inventor: Michael A. Siracki, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 16 days.

(21) Appl. No.: 14/302,119

(22) Filed: Jun. 11, 2014

(65) Prior Publication Data

US 2014/0367174 A1 Dec. 18, 2014

Related U.S. Application Data

(60) Provisional application No. 61/834,264, filed on Jun. 12, 2013.

(51) Int. Cl.
*E21B 10/633* (2006.01)
*E21B 10/573* (2006.01)

(52) U.S. Cl.
CPC ..... *E21B 10/633* (2013.01); *E21B 10/573* (2013.01)

(58) Field of Classification Search
CPC ..... E21B 10/573; E21B 10/5735; E21B 10/633; E21B 2010/624
See application file for complete search history.

(56) References Cited

U.S. PATENT DOCUMENTS 4,104,344 A 8/1978 Pope et al.
4,288,248 A 9/1981 Bovenkerk et al.
4,382,477 A 5/1983 Barr
5,127,923 A 7/1992 Bunting et al.
5,906,245 A * 5/1999 Tibbitts ..... E21B 10/5673 175/426
6,427,791 B1 * 8/2002 Glowka ..... E21B 10/633 175/413
7,703,559 B2 4/2010 Shen et al.
8,079,431 B1 12/2011 Cooley et al.
8,727,043 B2 * 5/2014 Zhang ..... E21B 10/573 175/413
8,881,848 B2 * 11/2014 Knull ..... E21B 10/567 175/408
8,991,523 B2 * 3/2015 Shen ..... E21B 10/633 175/331
2007/0278017 A1 12/2007 Shen et al.
2010/0108403 A1 5/2010 Keshavan
2010/0314176 A1 * 12/2010 Zhang ..... E21B 10/573 175/383
2011/0114393 A1 5/2011 Dolan et al.
2011/0297454 A1 12/2011 Shen et al.
2012/0073881 A1 * 3/2012 Shen ..... E21B 10/5673 175/428
2013/0140094 A1 6/2013 Burhan et al.
2013/0292185 A1 * 11/2013 Knull ..... E21B 10/567 175/408
2014/0360792 A1 * 12/2014 Azar ..... E21B 10/62 175/432

OTHER PUBLICATIONS

International Search Report and Written Opinion issued in corresponding International Application No. PCT/US2014/042058, mailed Oct. 13, 2014 (15 pages).

* cited by examiner

*Primary Examiner* — Shane Bomar

(57) ABSTRACT

A downhole cutting tool may include a tool body having at least one cutting element support structure formed thereon, wherein the at least one cutting element support structure comprises at least one cutter pocket formed therein; at least one cutter having at least substantially unobstructed cutting face retained within the at least one cutter pocket, the cutter pocket preventing substantial lateral movement of the at least one cutter; and at least one retention element interfacing a portion of a circumferential surface of the at least one cutter.

21 Claims, 7 Drawing Sheets

FIG. 8
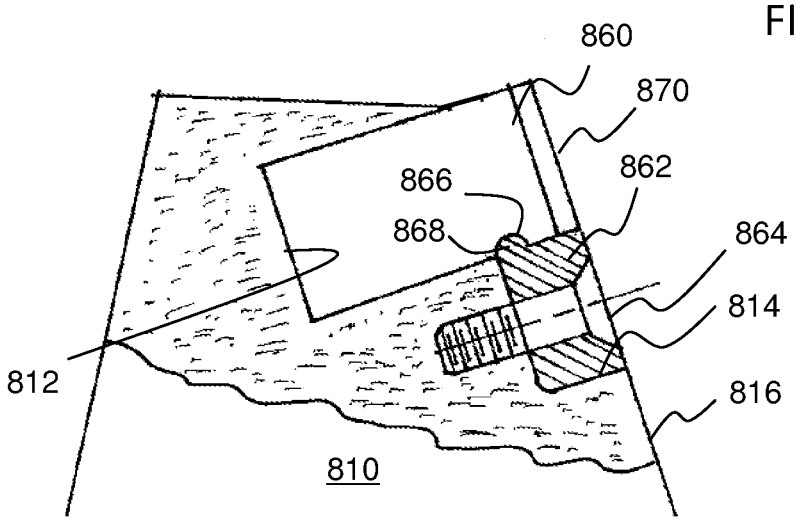
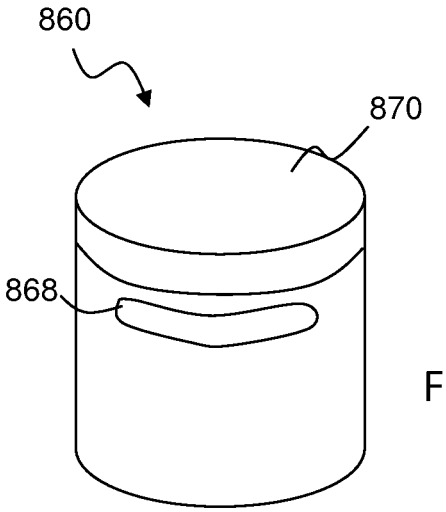
FIG. 9

CUTTING STRUCTURES AND STRUCTURES FOR RETAINING THE SAME

CROSS-REFERENCE TO RELATED APPLICATIONS

This application claims the benefit of U.S. Provisional Patent Application No. 61/834,264, filed on Jun. 12, 2013, which is herein incorporated by reference in its entirety.

BACKGROUND

Various types and shapes of earth boring bits are used in various applications in the earth drilling industry. Earth boring bits have bit bodies which include various features such as a core, blades, and cutter pockets that extend into the bit body or roller cones mounted on a bit body, for example. Depending on the application/formation to be drilled, the appropriate type of drill bit may be selected based on the cutting action type for the bit and its appropriateness for use in the particular formation.

Drag bits, often referred to as "fixed cutter drill bits," include bits that have cutting elements attached to the bit body, which may be a steel bit body or a matrix bit body formed from a matrix material such as tungsten carbide surrounded by a binder material. Drag bits may generally be defined as bits that have no moving parts. However, there are different types and methods of forming drag bits that are known in the art. For example, drag bits having abrasive material, such as diamond, impregnated into the surface of the material which forms the bit body are commonly referred to as "impreg" bits. Drag bits having cutting elements made of an ultrahard cutting surface layer or "table" (which may be made of polycrystalline diamond material or polycrystalline boron nitride material) deposited onto or otherwise bonded to a substrate are known in the art as polycrystalline diamond compact ("PDC") bits.

PDC bits drill soft formations easily, but they are frequently used to drill moderately hard or abrasive formations. They cut rock formations with a shearing action using small cutters that do not penetrate deeply into the formation. Because the penetration depth is shallow, high rates of penetration are achieved through relatively high bit rotational velocities.

PDC cutters have been used in industrial applications including rock drilling and metal machining for many years. In PDC bits, PDC cutters are received within cutter pockets, which are formed within blades extending from a bit body, and are generally bonded to the blades by brazing to the inner surfaces of the cutter pockets. The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

In some applications, a compact of polycrystalline diamond (PCD) (or other ultrahard material) is bonded to a substrate material, which may be a sintered metal-carbide to form a cutting structure. PCD comprises a polycrystalline mass of diamonds (often synthetic) that are bonded together to form an integral, tough, high-strength mass or lattice. The resulting PCD structure produces enhanced properties of wear resistance and hardness, making PCD materials extremely useful in aggressive wear and cutting applications where high levels of wear resistance and hardness are desired.

A PDC cutter may be formed by placing a sintered carbide substrate into the container of a press. A mixture of diamond grains or diamond grains and catalyst binder is placed atop the substrate and treated under high pressure, high temperature conditions. In doing so, metal binder (often cobalt) migrates from the substrate and passes through the diamond grains to promote intergrowth between the diamond grains. As a result, the diamond grains become bonded to each other to form the diamond layer, and the diamond layer is in turn integrally bonded to the substrate. The substrate may be made of a metal-carbide composite material, such as tungsten carbide-cobalt. The deposited diamond layer is often referred to as the "diamond table" or "abrasive layer."

An example of PDC bit having a plurality of cutters with ultrahard working surfaces is shown in FIGS. 1 and 2. The drill bit 100 includes a bit body 110 having a threaded upper pin end 111 and a cutting end 115. The cutting end 115 includes a plurality of ribs or blades 120 arranged about the rotational axis L (also referred to as the longitudinal or central axis) of the drill bit and extending radially outward from the bit body 110. Cutting elements, or cutters, 150 are embedded in the blades 120 at predetermined angular orientations and radial locations relative to a working surface and with a desired back rake angle and side rake angle against a formation to be drilled.

A plurality of orifices 116 are positioned on the bit body 110 in the areas between the blades 120, which may be referred to as "gaps" or "fluid courses." The orifices 116 are commonly adapted to accept nozzles. The orifices 116 allow drilling fluid to be discharged through the bit in selected directions and at selected rates of flow between the blades 120 for lubricating and cooling the drill bit 100, the blades 120 and the cutters 150. The drilling fluid also cleans and removes the cuttings as the drill bit 100 rotates and penetrates the geological formation. Without proper flow characteristics, insufficient cooling of the cutters 150 may result in cutter failure during drilling operations. The fluid courses are positioned to provide additional flow channels for drilling fluid and to provide a passage for formation cuttings to travel past the drill bit 100 toward the surface of a wellbore (not shown).

Referring to FIG. 2, a top view of a prior art PDC bit is shown. The cutting face 118 of the bit shown includes six blades 120-125. Each blade includes a plurality of cutting elements or cutters generally disposed radially from the center of cutting face 118 to generally form rows. Certain cutters, although at differing axial positions, may occupy radial positions that are in similar radial position to other cutters on other blades.

Cutters may be attached to a drill bit or other downhole tool by a brazing process. In the brazing process, a braze material is positioned between the cutter and the cutter pocket. The material is melted and, upon subsequent solidification, bonds (attaches) the cutter in the cutter pocket. Selection of braze materials depends on their respective melting temperatures, to avoid excessive thermal exposure (and thermal damage) to the diamond layer prior to the bit (and cutter) even being used in a drilling operation. Specifically, alloys suitable for brazing cutting elements with diamond layers thereon have been limited to a couple of alloys which offer low enough brazing temperatures to avoid damage to the diamond layer and high enough braze strength to retain cutting elements on drill bits.

A substantial factor in determining the longevity of PDC cutters is the exposure of the cutter to heat. Polycrystalline diamond may be stable at temperatures of up to 700-750° C. in air, above which observed increases in temperature may result in permanent damage to and structural failure of polycrystalline diamond. This deterioration in polycrystalline diamond is due to the substantial difference in the coefficient of thermal expansion of the binder material, cobalt, as compared to diamond. Upon heating of polycrystalline diamond, the cobalt and the diamond lattice will expand at different rates, which may cause cracks to form in the diamond lattice structure and result in deterioration of the polycrystalline diamond. Damage may also be due to graphite formation at diamond-diamond necks leading to loss of microstructural integrity and strength loss, at extremely high temperatures.

Exposure to heat (through brazing or through frictional heat generated from the contact of the cutter with the formation) can cause thermal damage to the diamond table and eventually result in the formation of cracks (due to differences in thermal expansion coefficients) which can lead to spalling of the polycrystalline diamond layer, delamination between the polycrystalline diamond and substrate, and conversion of the diamond back into graphite causing rapid abrasive wear. As a cutting element contacts the formation, a wear flat develops and frictional heat is induced. As the cutting element is continued to be used, the wear flat will increase in size and further induce frictional heat. The heat may build-up that may cause failure of the cutting element due to thermal mis-match between diamond and catalyst discussed above. This is particularly true for cutters that are immovably attached to the drill bit, as conventional in the art.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a downhole cutting tool that includes a tool body having at least one cutting element support structure formed thereon, wherein the at least one cutting element support structure comprises at least one cutter pocket formed therein; at least one cutter having at least substantially unobstructed cutting face retained within the at least one cutter pocket, the cutter pocket preventing substantial lateral movement of the at least one cutter; and at least one retention element interfacing a portion of a circumferential surface of the at least one cutter.

In another aspect, embodiments disclosed herein relate to a downhole cutting tool that includes a tool body having at least one cutter pocket and at least one retention pocket formed therein, the at least one retention pocket being radially adjacent to and intersecting a portion of the at least cutter pocket; at least one rolling cutter retained in the at least one cutter pocket, the at least one rolling cutter having a circumferential groove formed in a circumferential surface of the at least one rolling cutter; and at least one retention element retained in the at least one retention pocket, the at least one retention element having a substantially mating geometry with a portion of the circumferential groove of the at least one rolling cutter.

Other aspects and advantages of the claimed subject matter will be apparent from the following description and the appended claims.

BRIEF DESCRIPTION OF DRAWINGS

FIG. 8 shows a partial cross-sectional view of a downhole cutting tool including a mechanically retained cutter thereon.

FIG. 9 shows a perspective view of a cutter.

DETAILED DESCRIPTION

In one aspect, embodiments disclosed herein relate to drill bits and other downhole cutting tools using rotatable cutting structures (rolling cutters). In particular, embodiments disclosed herein relate to the retention of such rolling cutters on a drill bit or other downhole cutting tool. In another aspect, embodiments disclosed herein relate to drill bits and other downhole cutting tools using non-rotatable cutting elements that are mechanically retained on the drill bit or other downhole cutting tools.

Generally, rotatable cutting elements (also referred to as rolling cutters) described herein allow at least one surface or portion of the cutting element to rotate as the cutting elements contact a formation. As the cutting element contacts the formation, the cutting action may allow portion of the cutting element to rotate around a cutting element axis extending through the cutting element. Rotation of a portion of the cutting structure may allow for a cutting surface to cut the formation using the entire outer edge of the cutting surface, rather than the same section of the outer edge, as observed in a conventional cutting element. The following discussion describes various embodiments for retaining such rolling cutters as well as fixed, non-rotatable cutting elements.

One skilled in the art would appreciate that numerous variations on the cutting element capable of rotating may be used without departing from the scope of the present disclosure. For example, the rotation of the rolling cutter may be controlled by the side cutting force and the frictional force between the bearing surfaces. If the side cutting force generates a torque which can overcome the torque from the frictional force, the rotatable portion will have rotating motion. The side cutting force may be affected by cutter side rake, back rake and geometry, including the working surface patterns disclosed herein. Additionally, the side cutting force may be affected by the surface finishing of the surfaces of the cutting element components, the frictional properties of the formation, as well as drilling parameters, such as depth of cut. The frictional force at the bearing surfaces may affected, for example, by surface finishing, mud intrusion, etc. The design of the rotatable cutters disclosed herein may be selected to ensure that the side cutting force overcomes the frictional force to allow for rotation of the rotatable portion.

Figure 1:
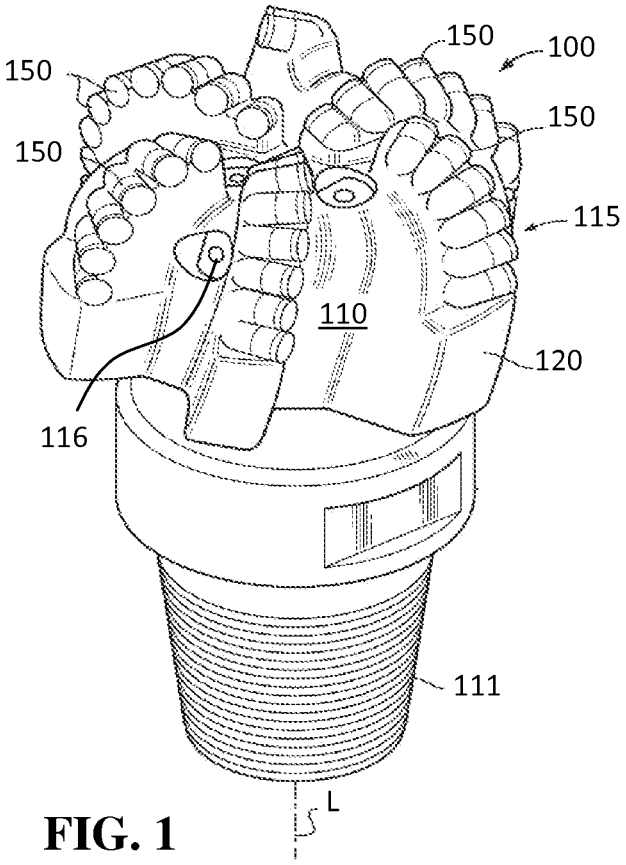
FIG. 1 (Prior Art)
FIG. 1 shows a side view of a conventional drag bit.
Figure 2:
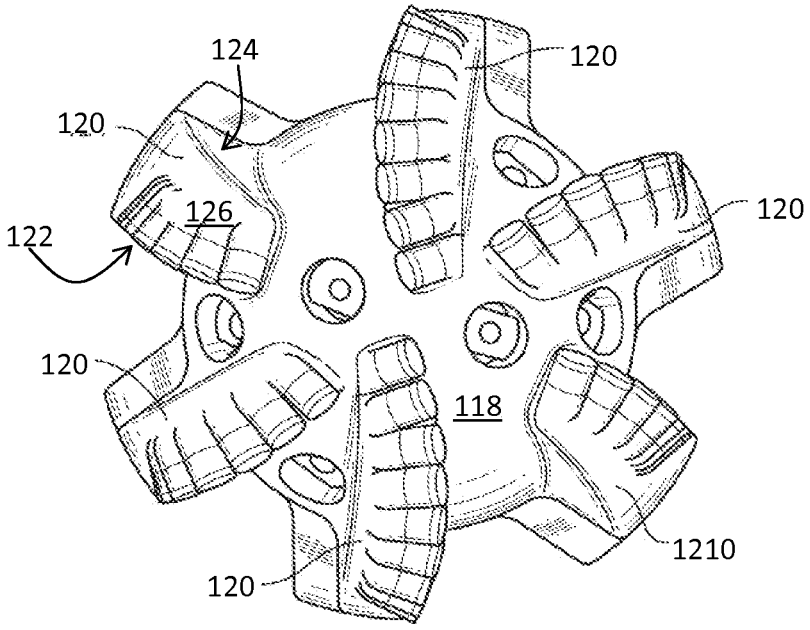
FIG. 2 (Prior Art)
FIG. 2 shows a top view of a conventional drag bit.
Figure 3:
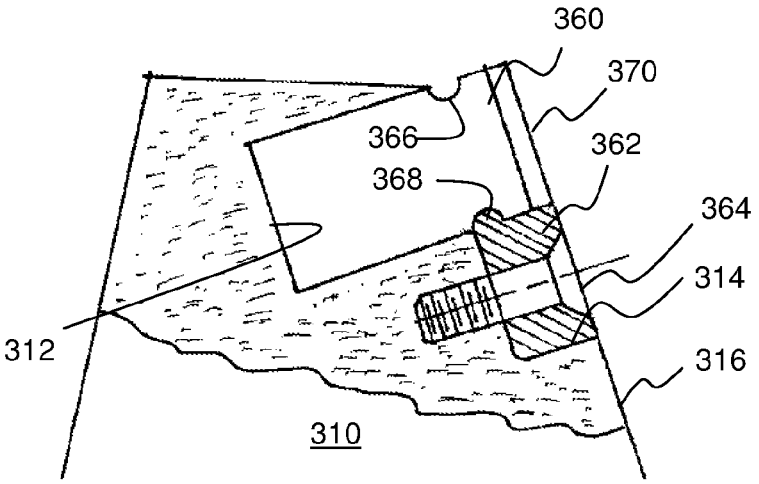
FIG. 3 shows a partial cross-sectional view of a downhole cutting tool including a rolling cutter thereon.
Figure 4:
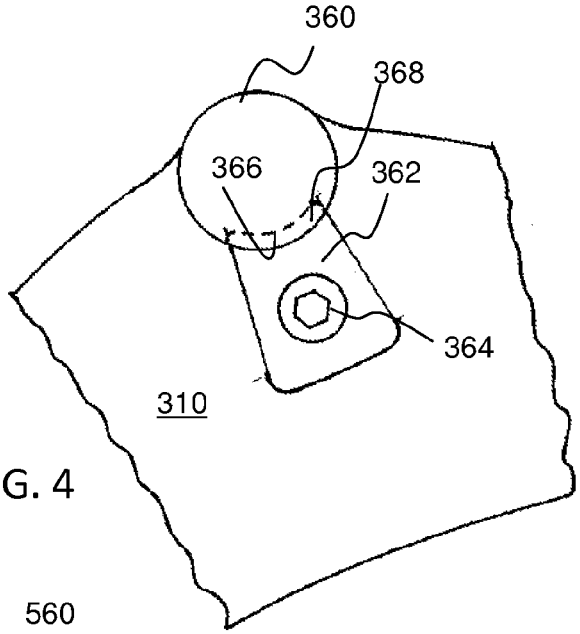
FIG. 4 shows a partial front view of a downhole cutting tool including a rolling cutter thereon.

Referring now to FIG. 3 (a partial cross-sectional view) and FIG. 4 (a partial front view) of a blade of a downhole cutting tool (such as a drill bit) are shown. In particular, each blade 310 on a drill bit or other downhole cutting tool (including, for example, primary blades and secondary blades) provides a cutter-supporting structure to which cutting elements 360 are mounted. As shown cutting elements 360 are rolling cutters, i.e., cutting elements 360 are retained in such a manner that allows the element to freely rotate; however, in one or more other embodiments, cutting elements 360 may be non-rotatable. Specifically, as shown, rolling cutters 360 are disposed/retained within cutter pocket 312, which may limit the lateral movement of the rolling cutter 360. Axial movement of the rolling cutter 360 out of pocket 312 is limited by retention element 362, which is disposed in a retention pocket 314 radially adjacent to and intersecting a portion of cutter pocket 312. In one or more embodiments, retention pocket extends around a partial circumference (ranging for example an arc length of less than 180 degrees, or from 60 to 120 degrees or 75 to 105 degrees in other embodiments) as well as a partial axial length of cutter pocket 312. In one or more embodiments, both retention pocket 314 and cutter pocket 312 interface a leading face 316 (i.e., facing in the direction of rotation of the bit or other tool) of blade 310. However, it is envisioned that the retention pocket 314 may also be formed on a trailing face of the blade 310 and extend into blade 310 to interface cutter pocket 312 and rolling cutter 360.

As mentioned above, axial movement of rolling cutter 360 out of pocket 312 is limited by retention element 362. Rolling cutters 360 may be allowed to move axially back into the back face of the cutter pocket 312 based on general forces experienced during drilling when weight on bit is applied, but retention element 362 keeps the rolling cutters 360 from falling out of the pocket 312. Specifically, such limitation may arise from the mating geometry of groove 366 formed in rolling cutter 360 and projection or lip 368 formed in retention element 362 (or vice versa), with some clearance therebetween to allow rolling cutter 360 to be able to rotate about its axis. Such clearance may depend on the size of the rolling cutters 360, for example, but in one or more embodiments may range from about 0.001 to about 0.005 inches (25.4 to 127 microns). However, in embodiments using fixed cutters retained by the retention element, such groove 362 may not extend around the entire circumference of the cutter 360 so that the cutter 360 is not free to rotate.

In one or more embodiments, retention element 362 may be retained within retention pocket 314 by a screw 364 or other fastener, or may be brazed in place in yet other embodiments. In the illustrated embodiment, screw 364 is inserted through a thru-hole in retention element 362 and engage with blade 310 (such as by threaded engagement) or a threaded bolt infiltrated into blade 310. Thus, in one or more embodiments, the assembly of rolling cutter 360 and retention element may be engaged together first, i.e., the projection or lip 368 may be fit into groove 366 of rolling cutter 360, the assembly may then be placed into cutter pocket 312, and finally, the retention element 362 may be secured to drill bit or other downhole tool.

By limiting axial movement along the side surface, the cutting face 370 of rolling cutter may remain substantially exposed and unobstructed. Further, in the illustrated embodiment, the cutting face and exposed face of retention element 362 may be substantially flush with one another; however, in other embodiments, the exposed face of the retention element 362 may be slightly recessed or protruding.

Figure 5:
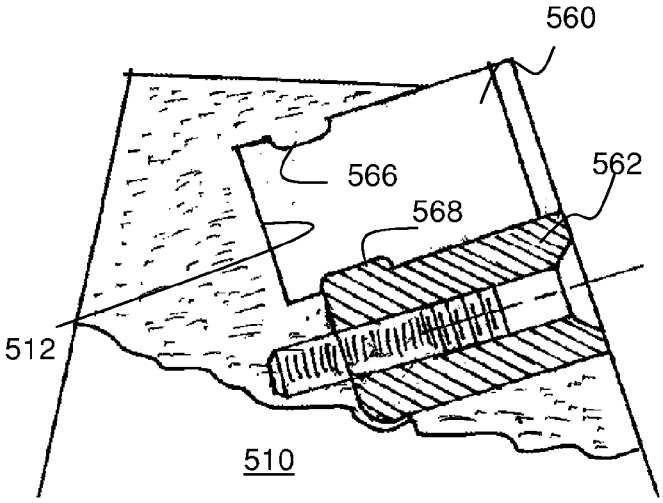
FIG. 5 shows a partial cross-sectional view of a downhole cutting tool including a rolling cutter thereon.

Referring now to FIG. 5, another embodiment of a rolling cutter 560 retained on a blade 510 is shown. As shown in FIG. 5, the axial location of the groove 566 on rolling cutter 560 and mating projection 568 on retention element 562 is varied, as compared to the embodiment illustrated in FIGS. 3-4. Thus, while the location of the groove 366/projection 368 is within the front third portion of rolling cutter 360, the location of groove 566/projection 568 is in the rear or back third portion of rolling cutter 560. Thus, retention element 562 interfaces rolling cutter along a substantial majority of the axial length of rolling cutter 560. Such difference also results in groove 366 being exposed along a portion of circumference of rolling cutter 360, whereas groove 566 is entirely contained within cutter pocket 512. The position of the groove/projection may be located at various positions along the axial length of the rolling cutter to provide the desired durability and access/ease of assembly and overall use.

Figure 6:
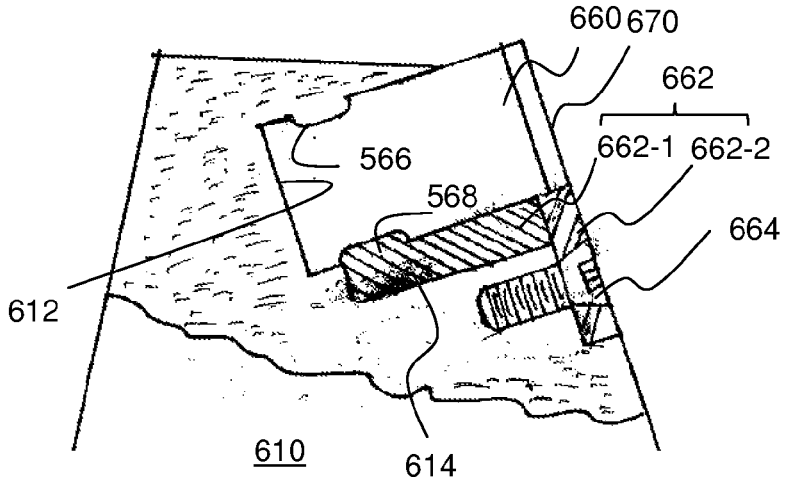
FIG. 6 shows a partial cross-sectional view of a downhole cutting tool including a rolling cutter thereon.
Figure 7:
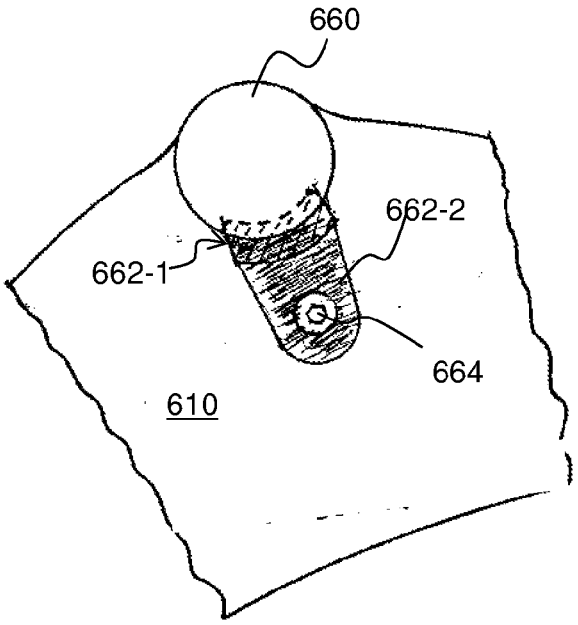
FIG. 7 shows a partial front view of a downhole cutting tool including a rolling cutter thereon.

Referring now to FIG. 6 (showing a partial cross-sectional view) and FIG. 7 (showing a partial front view) of a blade of a downhole cutting tool (such as a drill bit) are shown. As shown in FIGS. 6 and 7, retention element may include a plurality of components. For example, retention element 662 may include a rolling cutter interfacing component 662-1 (which interfaces and engages rolling cutter 660 to prevent axial movement thereof) and a fastener interfacing component 662-2 (engaged with fastener 664 to secure retention element 662 in place). In one or more embodiments, such two (or more)-piece construction may be desirable to use components of differing materials based on the function of the component part. For example, in one or more embodiments, the rolling cutter interfacing component 662-1 may be selected of a harder, more wear resistant material, as compared to fastener interfacing component 662-2, or vice versa. As shown, rolling cutter interfacing component 662-1 is an entirely internal component, and the axial front face thereof interfaces with a back face of fastener interfacing component 662-2. Thus, front face of fastener interfacing component 662-2 is exposed along the leading face 616 of blade. Further, as shown, the front or exposed face of fastener interfacing component 662-2 is substantially flush with cutting face 670 of rolling cutter 660; however, in other embodiments, the exposed face of the retention element 662 may be slightly recessed or protruding. In this embodiment, the cutting face 670 of rolling cutter 660 remains exposed and substantially unobstructed. Further, while retention element 662 (or a portion thereof) may be exposed and open to the leading face 616 of the blade, in one or more embodiments, it is noted that the retention element 662 and retention pocket 614 are not open to the blade top (top surface of the blade that will interface formation when the drill bit or other tool is in a well that is substantially perpendicular to the leading face 616 of the blade). That is, there is blade material 610 between the retention pocket 614 (in which retention element 662 sits) and the formation when the bit or other downhole cutting tool is in the wellbore.

Referring now to FIG. 8 (a partial cross-sectional view) of a blade of a downhole cutting tool (such as a drill bit) and a cutter (a perspective view) are shown. In particular, each blade 810 on a drill bit or other downhole cutting tool (including, for example, primary blades and secondary blades) provides a cutter-supporting structure to which cutting elements 860 are mounted. As shown cutting elements 860 are fixed cutters, i.e, cutting elements 860 are retained in such a manner that prevents rotation of the cutter. Specifically, as shown, fixed cutters 860 are disposed/retained within cutter pocket 812, which may limit the lateral movement of the fixed cutter 860. Axial movement of the fixed cutter 860 out of pocket 812 is limited by retention element 862, which is disposed in a retention pocket 814 radially adjacent to and intersecting a portion of cutter pocket 812. In one or more embodiments, retention pocket extends around a partial circumference (ranging for example an arc length of less than 180 degrees, or from 60 to 120 degrees or 75 to 105 degrees in other embodiments) as well as a partial axial length of cutter pocket 812. In one or more embodiments, both retention pocket 814 and cutter pocket 812 interface a leading face 816 (i.e., facing in the direction of rotation of the bit or other tool) of blade 810. However, it is envisioned that the retention pocket 814 may also be formed on a trailing face of the blade 810 and extend into blade 810 to interface cutter pocket 812 and rolling cutter 860.

As mentioned above, axial movement of fixed cutter 860 out of pocket 812 is limited by retention element 862. Fixed cutters 860 may be allowed to move axially back into the back face of the cutter pocket 812 based on general forces experienced during drilling when weight on bit is applied, but retention element 862 keeps the fixed cutters 860 from falling out of the pocket 812. Specifically, such limitation may arise from the mating geometry of groove 866 formed in fixed cutter 860 and projection or lip 868 formed in retention element 862 (or vice versa). In addition to limiting the axial movement, because groove 866, as illustrated, does not extend around the entire circumference of the cutter 860, rotation of cutter 360 is prevented. In one or more embodiments, the groove 866 may be circumferential (i.e., having a substantially constant depth around a partial circumference of the cutter and thus forming an arc at its furthest extent into the cutter around the circumference) or may be a "straight" groove or slot (i.e., having a variable depth around the partial circumference such that the furthest extent around the circumference forms a straight line). Additionally, other permutations are within the scope of the present disclosure such that the retention element also prevents rotation of the cutter 860. Projection or lip 868 (and thus groove 866) may extend the entire arc length of retention element 862, or it may extend for less than the entire arc length. The arc length of the retention element 862 include those variations described above with respect to the rolling cutter embodiment.

In one or more embodiments, retention element 862 may be retained within retention pocket 814 by a screw 864 or other fastener, or may be brazed in place in yet other embodiments. In the illustrated embodiment, screw 864 is inserted through a thru-hole in retention element 862 and engage with blade 810 (such as by threaded engagement) or a threaded bolt infiltrated into blade 810. Thus, in one or more embodiments, the assembly of fixed cutter 860 and retention element 862 may be engaged together first, i.e., the projection or lip 868 may be fit into groove 866 of fixed cutter 860, the assembly may then be placed into cutter pocket 812, and finally, the retention element 862 may be secured to drill bit or other downhole tool.

By limiting axial movement along the side surface, the cutting face 870 of fixed cutter 860 may remain substantially exposed and unobstructed. Further, in the illustrated embodiment, the cutting face 870 and exposed face of retention element 862 may be substantially flush with one another; however, in other embodiments, the exposed face of the retention element 862 may be slightly recessed or protruding. It is also intended that other variations on the cutter assembly described above in FIGS. 3-7 may also apply to the "fixed" cutter that is mechanically retained.

One or more embodiments described herein may have an ultrahard material disposed on a substrate. Such ultrahard materials may include a conventional polycrystalline diamond table (a table of interconnected diamond particles having interstitial spaces therebetween in which a metal component (such as a metal catalyst) may reside, a thermally stable diamond layer (i.e., having a thermal stability greater than that of conventional polycrystalline diamond, 750° C.) formed, for example, by substantially removing metal from the interstitial spaces between interconnected diamond particles or from a diamond/silicon carbide composite, or other ultrahard material such as a cubic boron nitride. Further, in particular embodiments, the rolling cutter may be formed entirely of ultrahard material(s), but the element may include a plurality of diamond grades used, for example, to form a gradient structure (with a smooth or non-smooth transition between the grades). In a particular embodiment, a first diamond grade having smaller particle sizes and/or a higher diamond density may be used to form the upper portion of the inner rotatable cutting element (that forms the cutting edge when installed on a bit or other tool), while a second diamond grade having larger particle sizes and/or a higher metal content may be used to form the lower, non-cutting portion of the cutting element. Further, it is also within the scope of the present disclosure that more than two diamond grades may be used.

As known in the art, thermally stable diamond may be formed in various manners. A typical polycrystalline diamond layer includes individual diamond "crystals" that are interconnected. The individual diamond crystals thus form a lattice structure. A metal catalyst, such as cobalt, may be used to promote recrystallization of the diamond particles and formation of the lattice structure. Thus, cobalt particles are generally found within the interstitial spaces in the diamond lattice structure. Cobalt has a substantially different coefficient of thermal expansion as compared to diamond. Therefore, upon heating of a diamond table, the cobalt and the diamond lattice will expand at different rates, causing cracks to form in the lattice structure and resulting in deterioration of the diamond table.

To obviate this problem, strong acids may be used to "leach" the cobalt from a polycrystalline diamond lattice structure (either a thin volume or entire tablet) to at least reduce the damage experienced from heating diamond-cobalt composite at different rates upon heating. Examples of "leaching" processes can be found, for example, in U.S. Pat. Nos. 4,288,248 and 4,104,344. Briefly, a strong acid, such as hydrofluoric acid or combinations of several strong acids may be used to treat the diamond table, removing at least a portion of the co-catalyst from the PDC composite. Suitable acids include nitric acid, hydrofluoric acid, hydrochloric acid, sulfuric acid, phosphoric acid, or perchloric acid, or combinations of these acids. In addition, caustics, such as sodium hydroxide and potassium hydroxide, have been used to the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc.

By leaching out the cobalt, thermally stable polycrystalline (TSP) diamond may be formed. In certain embodiments, a select portion (less than the entire body) of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such by processes known in the art and described in U.S. Pat. No. 5,127,923, which is herein incorporated by reference in its entirety.

In one or more other embodiments, TSP may be formed by forming the diamond layer in a press using a binder other than cobalt, one such as silicon, which has a coefficient of thermal expansion more similar to that of diamond than cobalt has. During the manufacturing process, a large portion, 80 to 100 volume percent, of the silicon reacts with the diamond lattice to form silicon carbide which also has a thermal expansion similar to diamond. Upon heating, any remaining silicon, silicon carbide, and the diamond lattice will expand at more similar rates as compared to rates of expansion for cobalt and diamond, resulting in a more thermally stable layer. PDC cutters having a TSP cutting layer have relatively low wear rates, even as cutter temperatures reach 1200° C. However, one of ordinary skill in the art would recognize that a thermally stable diamond layer may be formed by other methods known in the art, including, for example, by altering processing conditions in the formation of the diamond layer.

The substrate on which the cutting face is optionally disposed may be formed of a variety of hard or ultrahard particles. In one embodiment, the substrate may be formed from a suitable material such as tungsten carbide, tantalum carbide, or titanium carbide. Additionally, various binding metals may be included in the substrate, such as cobalt, nickel, iron, metal alloys, or mixtures thereof. In the substrate, the metal carbide grains are supported within the metallic binder, such as cobalt. Additionally, the substrate may be formed of a sintered tungsten carbide composite structure. It is well known that various metal carbide compositions and binders may be used, in addition to tungsten carbide and cobalt. Thus, references to the use of tungsten carbide and cobalt are for illustrative purposes only, and no limitation on the type substrate or binder used is intended. In another embodiment, the substrate may also be formed from a diamond ultrahard material such as polycrystalline diamond and thermally stable diamond. While the illustrated embodiments show the cutting face and substrate as two distinct pieces, one of skill in the art should appreciate that it is within the scope of the present disclosure the cutting face and substrate are integral, identical compositions. In such an embodiment, it may be desirable to have a single diamond composite forming the cutting face and substrate or distinct layers. Specifically, in embodiments where the cutting element is a rotatable cutting element, the entire cutting element may be formed from an ultrahard material, including thermally stable diamond (formed, for example, by removing metal from the interstitial regions or by forming a diamond/silicon carbide composite).

The retention element may be formed from a variety of materials. In one embodiment, the retention element may be formed of a suitable material such as tungsten carbide, tantalum carbide, or titanium carbide. Additionally, various binding metals may be included in the outer support element, such as cobalt, nickel, iron, metal alloys, or mixtures thereof, such that the metal carbide grains are supported within the metallic binder. It is also within the scope of the present disclosure that the retention element and/or substrate may also include one or more lubricious materials, such as diamond to reduce the coefficient of friction therebetween. The components may be formed of such materials in their entirely or have portions of the components including such lubricious materials deposited on the component, such as by chemical plating, chemical vapor deposition (CVD) including hollow cathode plasma enhanced CVD, physical vapor deposition, vacuum deposition, arc processes, or high velocity sprays). In a particular embodiment, a diamond-like coating may be deposited through CVD or hallow cathode plasma enhanced CVD, such as the type of coatings disclosed in US 2010/0108403.

In other embodiments, the retention may be formed of tool steel or other alloy steels, nickel-based alloys, and cobalt-based alloys. One of ordinary skill in the art would also recognize one or more components may be coated with a hardfacing material for increased erosion protection. Such coatings may be applied by various techniques known in the art such as, for example, detonation gun (d-gun) and spray-and-fuse techniques.

The cutting elements of the present disclosure may be incorporated in various types of cutting tools, including for example, as cutters in fixed cutter bits or hole enlargement tools such as reamers. Bits having the cutting elements of the present disclosure may include a single rolling cutter with the remaining cutting elements being conventional fixed cutting elements, each cutting element on the bit being rotatable, or any combination therebetween of rolling cutters and conventional (brazed), fixed cutters, as well as mechanically retained fixed cutters (including those of the present disclosure). Further, cutting elements of the present disclosure may be disposed on cutting tool blades (such as drag bit blades or reamer blades) having other wear elements incorporated therein. For example, cutting elements of the present disclosure may be disposed on diamond impregnated blades. Additionally, one of ordinary skill in the art would recognize that there exists no limitation on the sizes of the cutting elements of the present disclosure. For example, in various embodiments, the cutting elements may be formed in sizes including, but not limited to, 9 mm, 11 mm, 13 mm, 16 mm, and 19 mm.

Further, one of ordinary skill in the art would also appreciate that any of the design modifications as described above, including, for example, side rake, back rake, variations in geometry, surface alteration/etching, seals, bearings, material compositions, diamond or similar low-friction bearing surfaces, etc, may be included in various combinations not limited to those described above in the cutting elements of the present disclosure. In one embodiment, a cutter may have a side rake ranging from 0 to ±45 degrees. In another embodiment, a cutter may have a back rake ranging from about 5 to 35 degrees.

Figure 10:
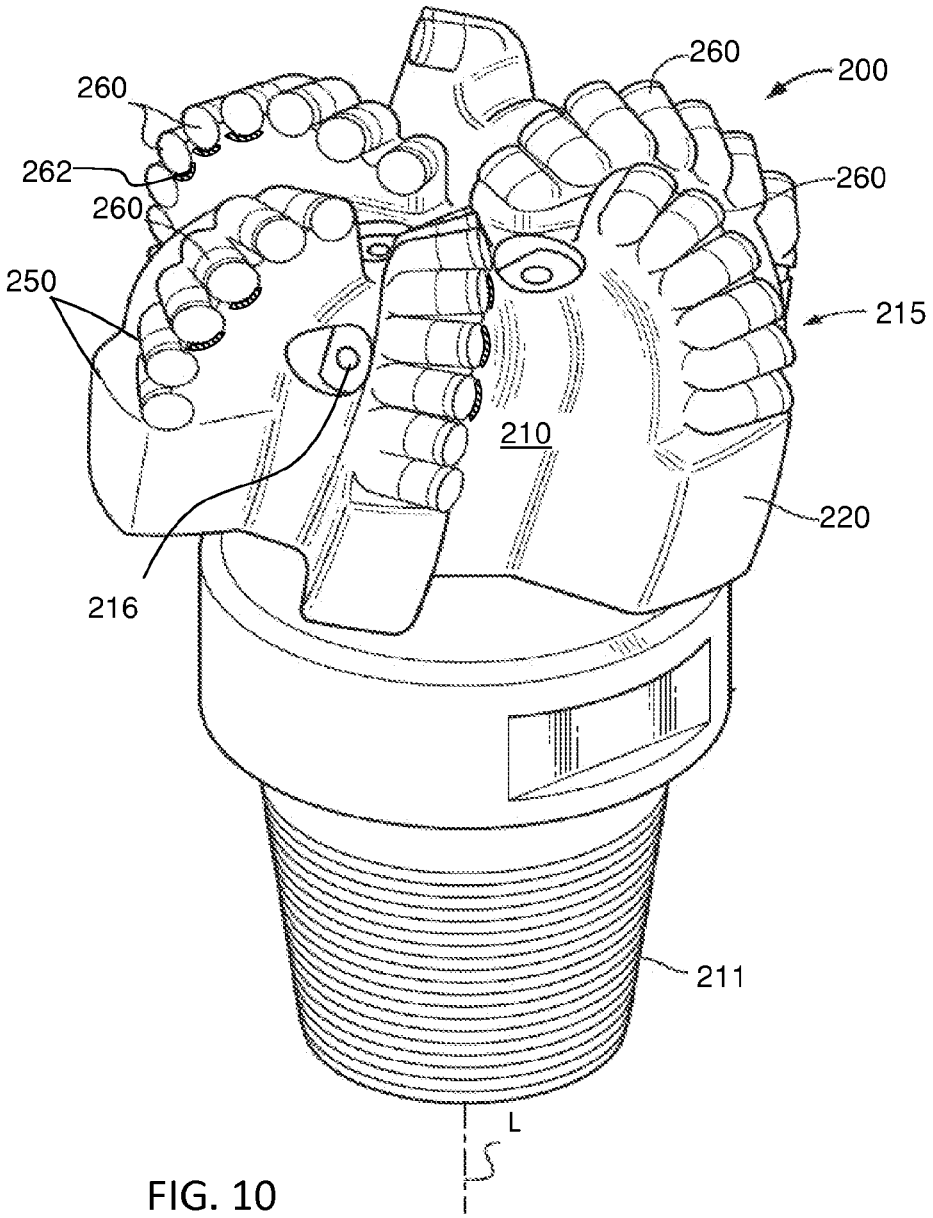
FIG. 10 shows a side view of a drill bit including a plurality of rolling cutters and a plurality of fixed cutters.

An example of PDC bit having a plurality of rolling cutters and fixed cutters is shown in FIG. 10. The drill bit 200 includes a bit body 210 having a threaded upper pin end 211 and a cutting end 215. The cutting end 215 includes a plurality of ribs or blades 220 arranged about the rotational axis L (also referred to as the longitudinal or central axis) of the drill bit and extending radially outward from the bit body 210. Conventional fixed cutting elements, or cutters, 250 are embedded in the blades 220 at predetermined angular orientations and radial locations relative to a working surface and with a desired back rake angle and side rake angle against a formation to be drilled. In addition to fixed cutters 250, the bit 200 also includes a plurality of rolling cutters 260, retained by retaining elements 262, as disclosed herein.

A plurality of orifices 216 are positioned on the bit body 210 in the areas between the blades 220, which may be referred to as "gaps" or "fluid courses." The orifices 216 are commonly adapted to accept nozzles. The orifices 216 allow drilling fluid to be discharged through the bit in selected directions and at selected rates of flow between the blades 220 for lubricating and cooling the drill bit 200, the blades 220, fixed cutters 250, and rolling cutters 260. The drilling fluid also cleans and removes the cuttings as the drill bit 200 rotates and penetrates the geological formation. The fluid courses are positioned to provide additional flow channels for drilling fluid and to provide a passage for formation cuttings to travel past the drill bit 200 toward the surface of a wellbore (not shown).

Figure 11:
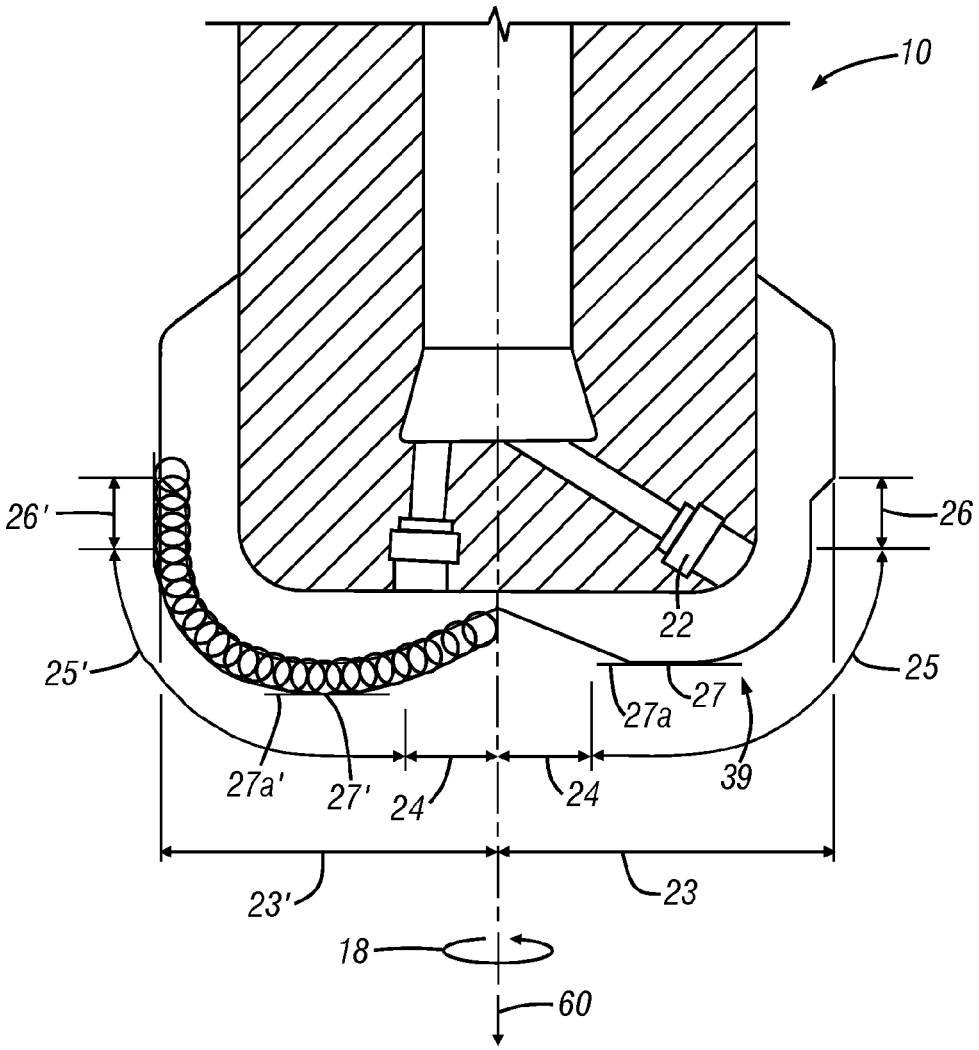
FIG. 11 shows a rotated profile view of a drill bit.

In one or more embodiments, rolling cutters may be disposed in locations of the bit or other tool experiencing the greatest wear, such as the nose or shoulder of the bit. Referring now to FIG. 11, a profile of bit 10 is shown as it would appear with all blades and cutting faces 44 of all cutting elements 40 (including both fixed cutters such as those referenced as 250 in FIG. 10 and rolling cutters such as those referenced as 260 in FIG. 10) rotated into a single rotated profile. In rotated profile view, blade tops of all blades of bit form and define a combined or composite blade profile 39 that extends radially from bit axis 60 to outer radius 23 of bit 10. Thus, as used herein, the phrase "composite blade profile" refers to the profile, extending from the bit axis to the outer radius of the bit, formed by the blade tops of all the blades of a bit rotated into a single rotated profile (i.e., in rotated profile view). In one or more embodiments, the cutters referenced as 260 may be mechanically retained in accordance with the present disclosure, but not able to rotate.

Composite blade profile 39 (most clearly shown in the right half of bit 10 in FIG. 11) may generally be divided into three regions conventionally labeled cone region 24, shoulder region 25, and gage region 26. Cone region 24 comprises the radially innermost region of bit 10 and composite blade profile 39 extending generally from bit axis 60 to shoulder region 25. As shown in FIG. 11, in most conventional fixed cutter bits, cone region 24 is generally concave. Adjacent cone region 24 is shoulder (or the upturned curve) region 25. In most conventional fixed cutter bits, shoulder region 25 is generally convex. Moving radially outward, adjacent shoulder region 25 is the gage region 26 which extends parallel to bit axis 60 at the outer radial periphery of composite blade profile 39. Thus, composite blade profile 39 of bit 10 includes one concave region—cone region 24, and one convex region—shoulder region 25.

The axially lowermost point of convex shoulder region 25 and composite blade profile 39 defines a blade profile nose 27. At blade profile nose 27, the slope of a tangent line 27*a* to convex shoulder region 25 and composite blade profile 39 is zero. Thus, as used herein, the term "blade profile nose" refers to the point along a convex region of a composite blade profile of a bit in rotated profile view at which the slope of a tangent to the composite blade profile is zero. For most conventional fixed cutter bits (e.g., bit 10), the composite blade profile includes a single convex shoulder region (e.g., convex shoulder region 25), and a single blade profile nose (e.g., nose 27). In one or more embodiments, rolling cutters of the present disclosure may be located in the nose and/or shoulder region of the cutting profile, and fixed cutters may be located in the cone and/or gage of the cutting profile. In other embodiments, the rolling cutters may also be disposed in the cone and/or gage of the cutting profile. For example, referring back to FIG. 9, rolling cutters 260 are located in at least some of the nose and shoulder regions of the blades 220, while fixed cutters 250 are located in the cone and gage regions of the blade 220. It is also within the scope of the present disclosure that the nose and shoulder may also include fixed cutters as either primary or back-up cutting elements.

Figure 12:
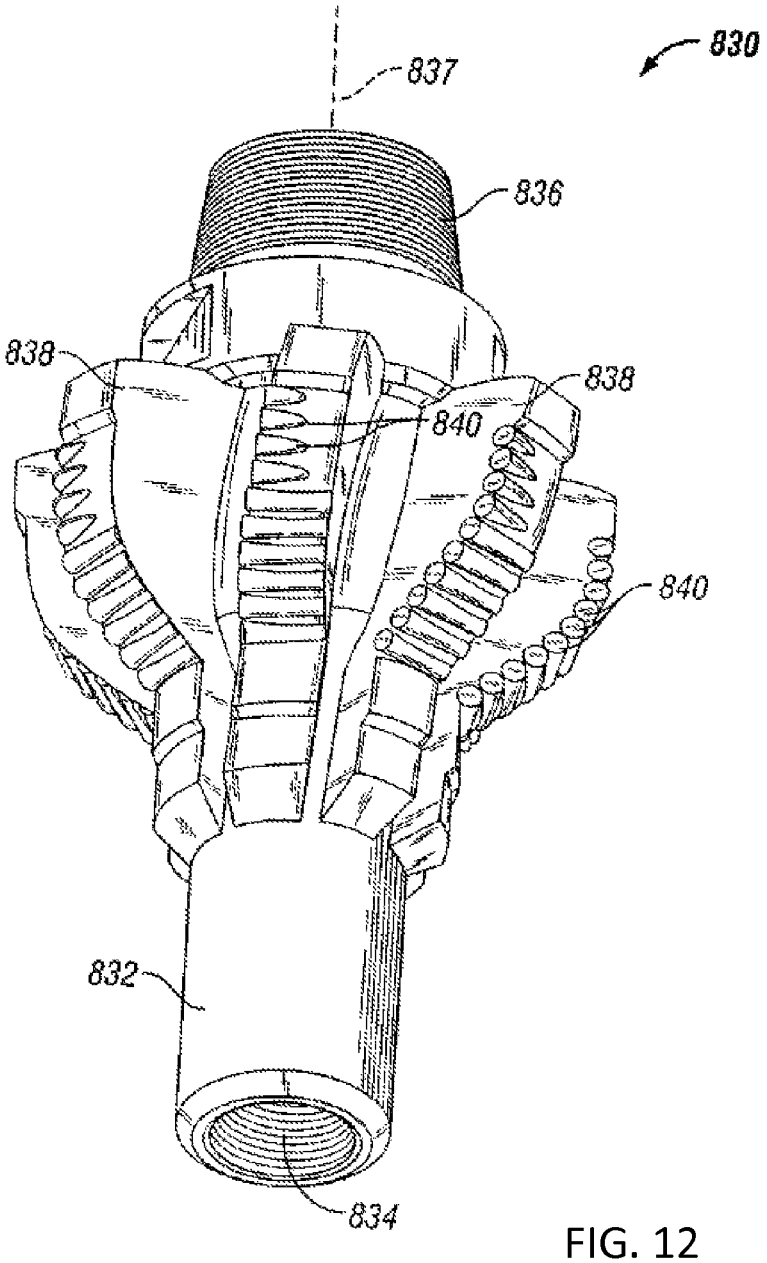
FIG. 12 shows a tool that may use the cutting elements of the present disclosure.

As described throughout the present disclosure, the cutting elements may be used on any downhole cutting tool, including, for example, a fixed cutter drill bit or hole opener. FIG. 12 shows a general configuration of a hole opener 830 that includes one or more cutting elements of the present disclosure. The hole opener 830 comprises a tool body 832 and a plurality of blades 838 disposed at selected azimuthal locations about a circumference thereof. The hole opener 830 generally comprises connections 834, 836 (e.g., threaded connections) so that the hole opener 830 may be coupled to adjacent drilling tools that comprise, for example, a drillstring and/or bottom hole assembly (BHA) (not shown). The tool body 832 generally includes a bore therethrough so that drilling fluid may flow through the hole opener 830 as it is pumped from the surface (e.g., from surface mud pumps (not shown)) to a bottom of the wellbore (not shown). The tool body 832 may be formed from steel or from other materials known in the art. For example, the tool body 832 may also be formed from a matrix material infiltrated with a binder alloy. The blades 838 shown in FIG. 12 are spiral blades and are generally positioned at substantially equal angular intervals about the perimeter of the tool body. This arrangement is not a limitation on the scope of the invention, but rather is used merely to illustrative purposes. Those having ordinary skill in the art will recognize that any prior art downhole cutting tool may be used. While FIG. 12 does not detail the location of the rolling cutters or mechanically retained cutters, their placement on the tool may be according to all the variations described above.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed:

1. A downhole cutting tool, comprising:

a tool body having at least one cutting element support structure formed thereon, wherein the at least one cutting element support structure comprises at least one cutter pocket formed therein at a retention pocket radially adjacent to the at least one cutter pocket and intersecting a leading face of the at least one cutting element support structure;

at least one cutter, having a substantially unobstructed cutting face, retained within the at least one cutter pocket, the cutter pocket preventing substantial lateral movement of the at least one cutter; and at least one retention element interfacing a partial circumferential surface of the at least one cutter of less than 180 degrees, wherein the retention element is disposed in the retention pocket.

2. The downhole cutting tool of claim 1, wherein the at least one cutter is a rolling cutter.

3. The downhole cutting tool of claim 1, wherein an exposed face of the at least one retention element is substantially flush with the substantially unobstructed cutting face of the at least one cutter.

4. The downhole cutting tool of claim 1, wherein the retention element comprises a thru-hole therein, and is retained by a fastener extending through the thru-hole.

5. The downhole cutting tool of claim 1, wherein the retention element limits axial movement of the cutter in at least one axial direction.

6. The downhole cutting tool of claim 1, wherein the at least one retention element is brazed in place.

7. The downhole cutting tool of claim 1, wherein the at least one retention element comprises at least two pieces interfacing a side surface of the at least one cutter.

8. The downhole cutting tool of claim 2, further comprising at least one fixed cutting element, wherein each fixed cutting element is disposed in one of the cutter pockets.

9. The downhole cutting tool of claim 2, wherein the downhole cutting tool is a fixed cutter bit comprising a bit body and a plurality of blades extending from the bit body, wherein the at least one cutter pocket is formed in one of the plurality of blades.

10. A downhole cutting tool, comprising:

a tool body having at least one cutter pocket and at least one retention pocket formed therein, the at least one retention pocket being radially adjacent to and intersecting a portion of the at least one cutter pocket;

at least one rolling cutter retained in the at least one cutter pocket, the at least one rolling cutter having a circumferential groove formed in a circumferential surface of the at least one rolling cutter; and at least one retention element retained in the at least one retention pocket, the at least one retention element having a substantially mating geometry with a portion of the circumferential groove of the at least one rolling cutter, the retention element comprising a thru-hole therein, the retention element being retained by a fastener extending through the thru-hole.

11. The downhole cutting tool of claim 10, wherein the at least one retention element interfaces a partial circumference of the at least one rolling cutter by less than 180 degrees.

12. The downhole cutting tool of claim 10, wherein an exposed face of the at least one retention element is substantially flush with a cutting face of the at least one rolling cutter.

13. The downhole cutting tool of claim 10, wherein a cutting face of the at least one rolling cutter is substantially unobstructed.

14. The downhole cutting tool of claim 10, wherein the retention pocket intersects a leading face of at least one cutting element support structure of the tool body.

15. The downhole cutting tool of claim 10, wherein the retention element limits axial movement of the rolling cutter in at least one axial direction.

16. The downhole cutting tool of claim 10, wherein the at least one retention element is brazed in place.

17. The downhole cutting tool of claim 10, wherein the at least one retention element comprises at least two pieces interfacing a side surface of the at least one rolling cutter.

18. The downhole cutting tool of claim 10, further comprising at least one fixed cutting element, wherein each fixed cutting element is disposed in one of the cutter pockets.

19. The downhole cutting tool of claim 10, wherein the downhole cutting tool is a fixed cutter bit comprising a bit body and a plurality of blades extending from the bit body, wherein the at least one cutter pocket is formed in one of the plurality of blades.

20. A fixed cutter downhole tool, comprising:

a body;

a blade extending from the body, the blade having a leading face, a cutter pocket intersecting the leading face, and a retention pocket radially adjacent to the cutter pocket and intersecting the cutter pocket and the leading face;

a cutter retained in the cutter pocket, the cutter having a cutting face that is substantially unobstructed and exposed to formation to be drilled; and a retention element retained in the retention pocket and securing the cutter to the blade, the retention element interfacing the blade and a geometry of the cutter.

21. The fixed cutter downhole tool of claim 20, wherein the retention element:

(a) includes a thru-hole and is secured to the blade by a fastener extending through the thru-hole;

(b) interfaces the geometry of the cutter around a partial circumferential surface of less than 180 degrees of the cutter; or (c) both (a) and (b).

* * * * *